US006089163A

United States Patent [19]

Williams

[11] Patent Number: 6,089,163

[45] Date of Patent: Jul. 18, 2000

[54] APPARATUS FOR ADJUSTING THE DISTANCE BETWEEN RAILS

[76] Inventor: Barnett Williams, 781 E. Lehigh Dr., Newport, Tenn. 37821

[21] Appl. No.: 09/158,240

[22] Filed: Sep. 22, 1998

[51] Int. Cl.[7] ..... E01B 29/00

[52] U.S. Cl. ..... 104/2; 104/7.1; 104/7.2; 104/8

[58] Field of Search ..... 104/2, 7.2, 8, 7.1; 294/88

[56] References Cited

U.S. PATENT DOCUMENTS

| | | | |
|---|---|---|---|
| 2,926,616 | 3/1960 | Talboys | 104/8 |
| 3,417,708 | 12/1968 | Sauterel | 104/8 |
| 3,557,459 | 1/1971 | Plasser et al. . | |
| 3,685,157 | 8/1972 | Plasser et al. . | |
| 3,952,665 | 4/1976 | Stewart et al. | 104/8 |
| 4,399,753 | 8/1983 | Theurer et al. | 104/2 |
| 4,534,296 | 8/1985 | Stubbs et al. | 104/8 |
| 4,574,704 | 3/1986 | Cicin-Sain . | |
| 4,658,730 | 4/1987 | von Beckmann et al. . | |
| 4,669,387 | 6/1987 | Casarini et al. | 104/2 |
| 4,703,968 | 11/1987 | LaBounty | 294/88 |
| 4,903,608 | 2/1990 | Theurer et al. . | |
| 5,481,982 | 1/1996 | Theurer et al. . | |
| 5,598,782 | 2/1997 | Weisman et al. . | |
| 5,613,442 | 3/1997 | Ahola et al. . | |

*Primary Examiner*—S. Joseph Morano
*Assistant Examiner*—Lars A. Olson
*Attorney, Agent, or Firm*—Pitts & Brittian, P.C.

[57] ABSTRACT

A system for adjusting the separation distance between adjacent rails over which vehicles travel, the apparatus including a vehicle moveable along the rails and including a boom or pivoted art member mounted on the frame, the boom or arm extending in cantilevered fashion from a pivot mount to and terminating adjacent one end of the vehicle. A rail gripper is mounted on, and oriented normal to, the boom or arm and includes telescoping members extending laterally of and between the rails. Each end of the rail gripper is provided with one or more lug members adapted to engage a respective rail for the applying of a moving force to the rail in a direction substantially normal to the length of the rail and selectively toward or away from its companion rail. A hydraulically power assembly associated with the vehicle provides a power source of power for retraction and extension of the telescoping arm of the rail gripper, plus other functions, such as moving the rail gripper between positions of engagement and disengagement with the rails. The vehicle may be a portable dolly or a backhoe or similar vehicle.

17 Claims, 7 Drawing Sheets

APPARATUS FOR ADJUSTING THE DISTANCE BETWEEN RAILS

FIELD OF INVENTION

The present invention relates generally to apparatus and methods for gauging and adjusting the distance between rails for vehicular traffic, and more particularly to an apparatus and a method for gauging and mechanically adjusting the distance between rails of railroad tracks.

BACKGROUND OF INVENTION

Numerous devices and methods have been employed by railroad companies to gauge the distance between rails of railroad tracks, and to adjust tracks that have moved to a non-specification spacing therebetween. Non-specification spacing between rails can endanger the safe operation of rail traffic over the tracks. Prior devices have included mechanical and/or optical gauging devices and correction mechanisms on multiple cars which in general are cumbersome and complicated, and costly to manufacture, operate, and maintain.

As employed in the present invention, the term "gauge" is at times used an a noun and indicates an instrument employing in gauging something, or in certain instances as the state of being "in gauge" or "out of gauge", and is at times used as a verb indicating "the act of gauging", all as will be apparent from the context in which the term is used.

Accordingly, it is an object of the present invention to provide a mobile apparatus for adjusting the distance between rails for vehicular traffic employing a single mobile vehicle.

It is a further object of the present invention to provide an apparatus for adjusting the distance between adjacent rails and which is light-weight and easily maneuverable by one operator.

It is an additional object of the present invention to provide a method by which a single operator can readily gauge the distance between rails of parallel tracks or the like, and adjust the distance between such rails.

BRIEF DESCRIPTION OF DRAWINGS

These and other objects and advantages of the present invention will become apparent from the description contained herein, including the claims and the drawings, in which:

SUMMARY OF INVENTION

In accordance with one aspect of the present invention there is provided a mobile vehicle having a frame and first and second sets of wheel assemblies adapted to mount the frame between the rails and to ride along the length of the rails; a mounting arm or boom pivotally mounted to the frame, the arm having one end extending from the vehicle in cantilevered fashion to a terminal location adjacent one end of the vehicle. A rail gripper is mounted on the terminal end of the mounting arm or boom at a position outboard of the vehicle and oriented normal to the length of the rails. The rail gripper includes a telescoping member having first and second opposite ends and which extends laterally of the rails, each of the ends terminating adjacent a respective one of the rails.

In accordance with one aspect of the invention, each of the ends of the rail gripper includes one or more depending lug members adapted to engage a respective rail for the applying of a moving force to the rail in a direction substantially normal to the length of the rail. In one embodiment a hydraulically powered subassembly is provided for extending and retracting the telescoping member, hence the rail gripper. A controller is provided to direct power to the hydraulically powered subassembly from a power source mounted on the frame, the controller selectively providing for lengthening and shortening the distance between the lug members on the ends of the rail gripper to thereby move the rails into gauge. A gauge mechanism may be associated with the vehicle, the gauge having opposite ends, each of the ends being adapted to engage a respective one of the rails and to be moved therealong from location to location in association with the vehicle, the gauge including an indicator providing a visual or audible indication of the spatial distance between the rails at a given location of the vehicle, and indicating the gauge of the rails.

DETAILED DESCRIPTION OF INVENTION

In FIGS. 1–8, there is depicted one embodiment of an apparatus embodying various of the features of the present invention. The depicted embodiment comprises a mobile vehicle 10 designed to travel on and along the length of the rails R and R' of railroad tracks. The mobile vehicle 10 is light-weight and is transportable to the site of railroad tracks undergoing gauging and aligning where it may be placed onto the tracks by one or two persons. As depicted, the vehicle 1 supports the gauging and adjusting equipment necessary to allow one person to gauge and adjust the distance between rails R and R' to within proper specifications.

Figure 1:
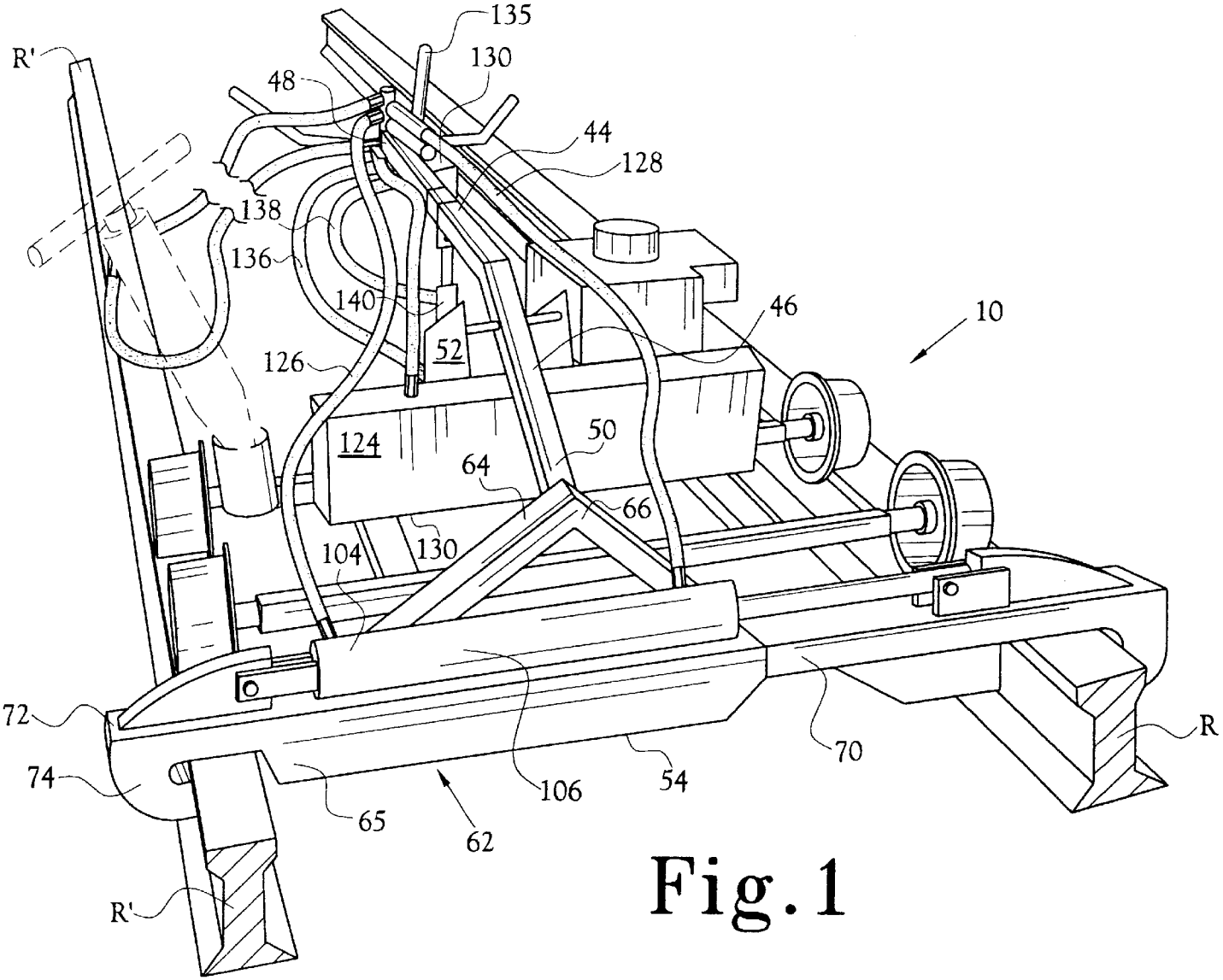
FIG. 1 is a front perspective view of one embodiment of apparatus for adjusting the distance between rails embodying various features of the present invention.
Figure 3:
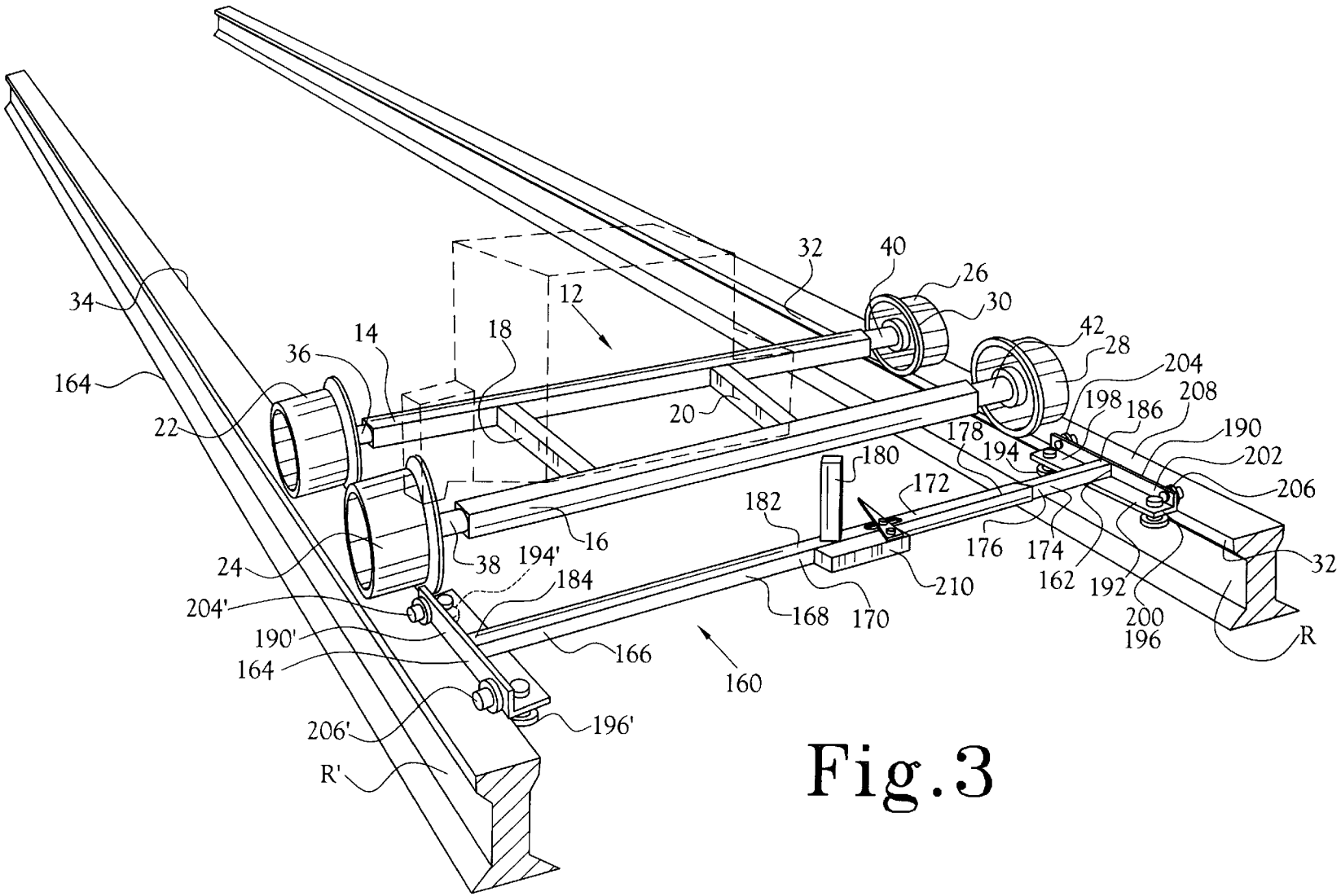
FIG. 3 is a rear perspective view of one embodiment of the apparatus embodying various features of the invention and mounted on the rails of a railroad track.

In the embodiment depicted in FIGS. 1 and 3, the vehicle comprises a frame 12 supported on first and second axles 14 and 16, each axle having a pair of wheel assemblies adapted to mount the frame 12 between the rails R and R' and to ride along the length of rails for movement of vehicle from location to location. The axles 14 and 16 are interconnected by a plurality of rigid cross members 18,20 which complete the frame (see FIG. 3) and provide rigidity to the frame as well as structural support for various components of the present invention. In a preferred embodiment, each wheel 22,24,26,28 includes a flanged inner perimeter 30 (typical) that rides against respective ones of the upper inside edges 32 and 34, respectively, of the rails to ensure that the vehicle remains on the rails and with the vehicle centered between the rails.

In one embodiment, the wheels are rotatably mounted on respective hubs 36,38,40 and 42 that project from the opposing ends of the axles 14 and 16. These hubs provide for the adjustment of the lateral spacing between the wheels on the opposite ends of each axle so that the vehicle may be mounted on different width tracks, such as the standard, narrow and wide gauge railroad tracks.

Figure 2:
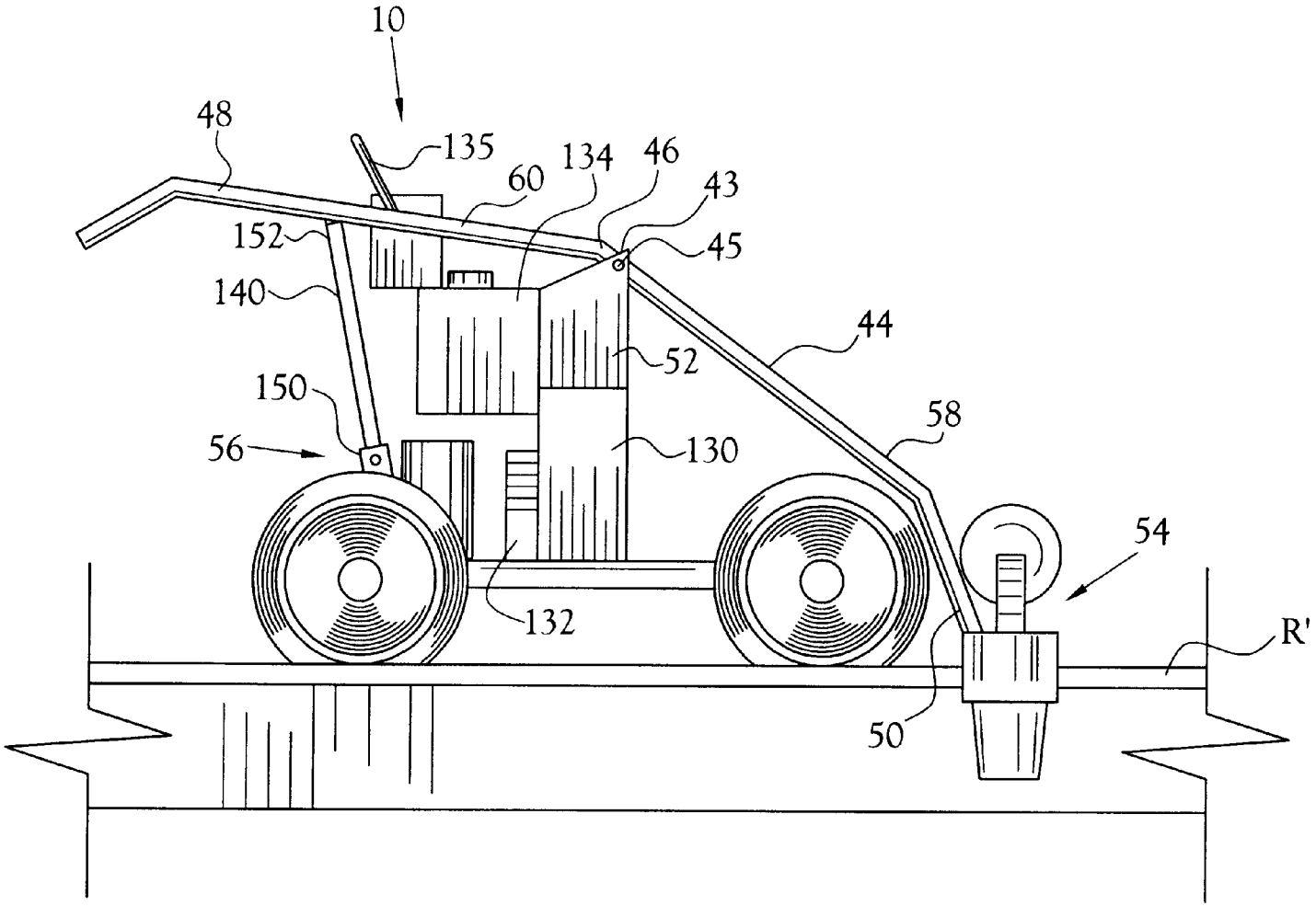
FIG. 2 is a right-hand side view of the apparatus depicted in FIG. 1.

With particular reference to FIGS. 1 and 2 (in which various components of the apparatus are omitted for purposes of clarity), the frame 12 of the vehicle is provided with an elongated rigid mounting arm 44. This arm is pivotally mounted as by a pivot pin 45, at a location 46 about midway between the opposite ends 48 and 50 of the arm, to an upstanding rigid support member 52 which is located approximately halfway between the front and rear ends 54 and 56, respectively, of the vehicle. A forward portion 58 of the arm 44 extends in cantilevered fashion from its pivotal mounting 43 toward, and terminates adjacent to, the front end 54 of the vehicle. A rear portion 60 of the arm extends in cantilevered fashion from its pivotal mounting 43 toward and terminates adjacent the rear end 56 of the vehicle. The height of the support member 52, hence the height of the location of the pivotal mounting 43 of the arm on the support member 52 is chosen such that the arm may be of a length about equal to the distance between the front end and the rear end of the vehicle and thereby provide for substantial arcuate movement of the terminal end of each portion of the arm for purposes that will appear hereinafter.

That portion 58 of the arm which extends toward the front end of the vehicle and terminates adjacent the front end of the vehicle is provided with a rail gripper assembly 62. This gripper assembly, in the depicted embodiment, includes rigid mounting members 64 and 66 which depend from the terminal end 50 of the forward portion 58 of the arm to receive and mount thereon a first rigid hollow tubular member 68 in a position forward of the front end of the vehicle and depending from the terminal end of the arm. The gripper assembly further includes a second elongated rigid member 70 which is telescopically and slidably received within the first rigid tubular member 68. In combination, these first and second telescoping members span the separation distance between the adjacent rails to be gauged.

Figure 4:
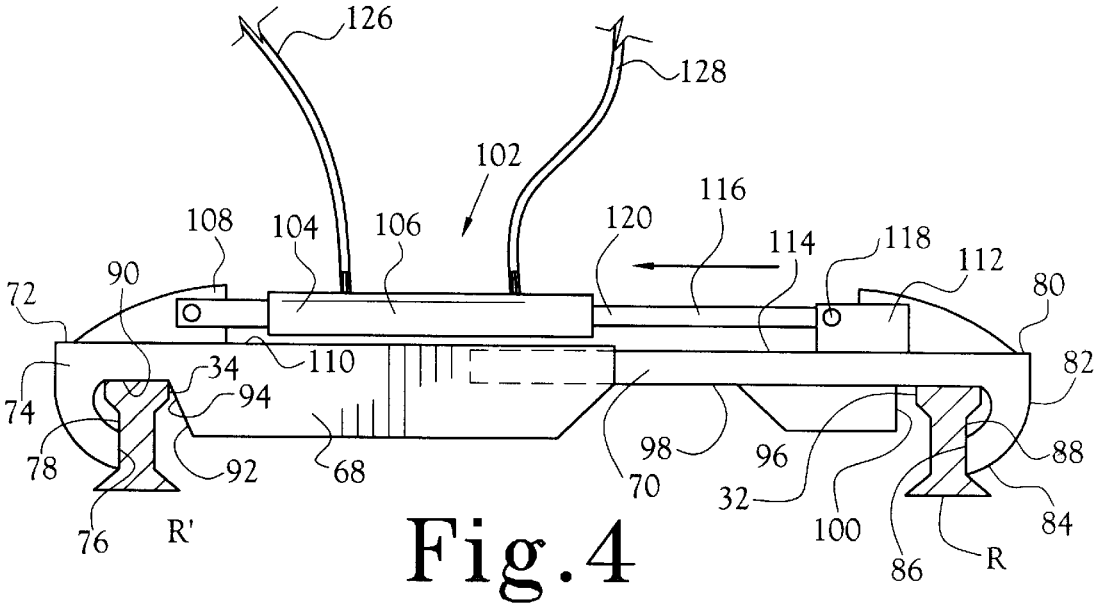
FIG. 4 is a front elevation view of a rail gripper and depicting the gripper in engagement with the rails of a railroad track.
Figure 5:
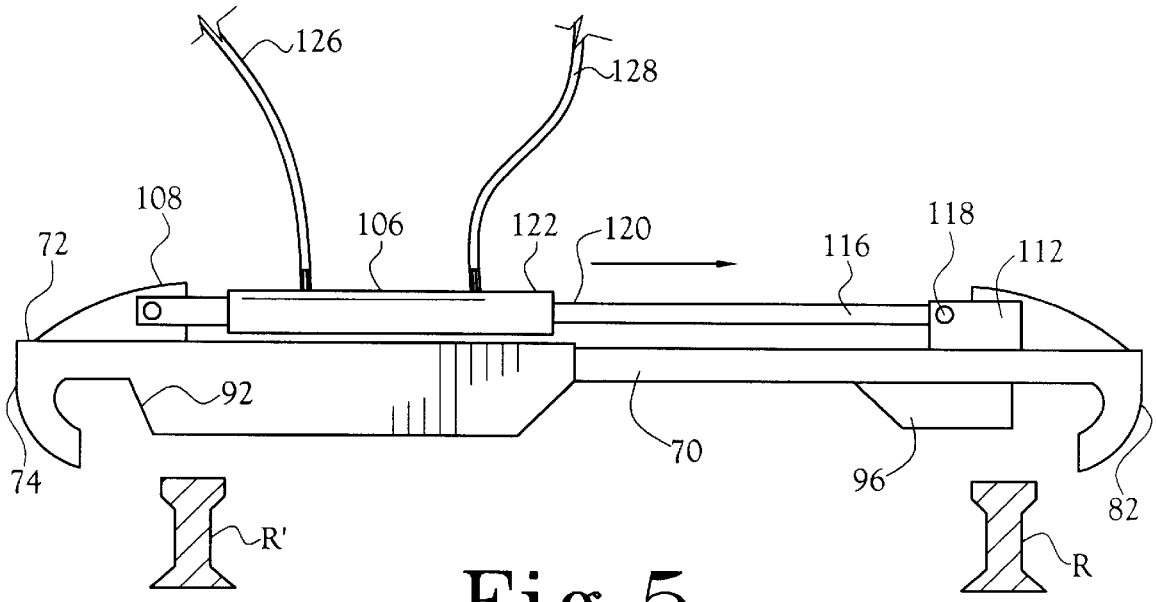
FIG. 5 is a front elevation view of the rail gripper and depicting the gripper out of engagement with the rails of a railroad track.
Figure 6:
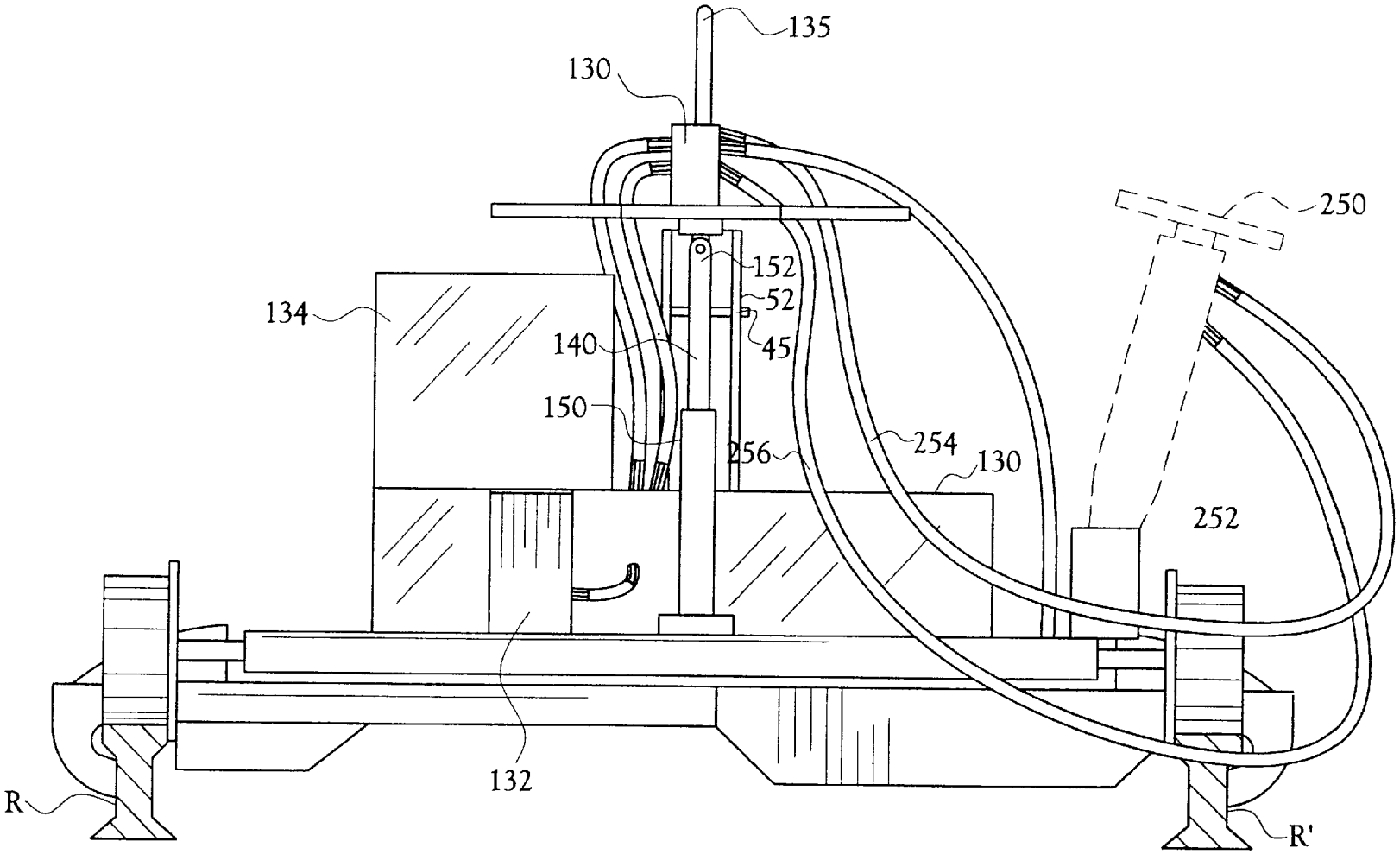
FIG. 6 is a rear elevation view of one embodiment of the apparatus of the present invention.
Figure 7:
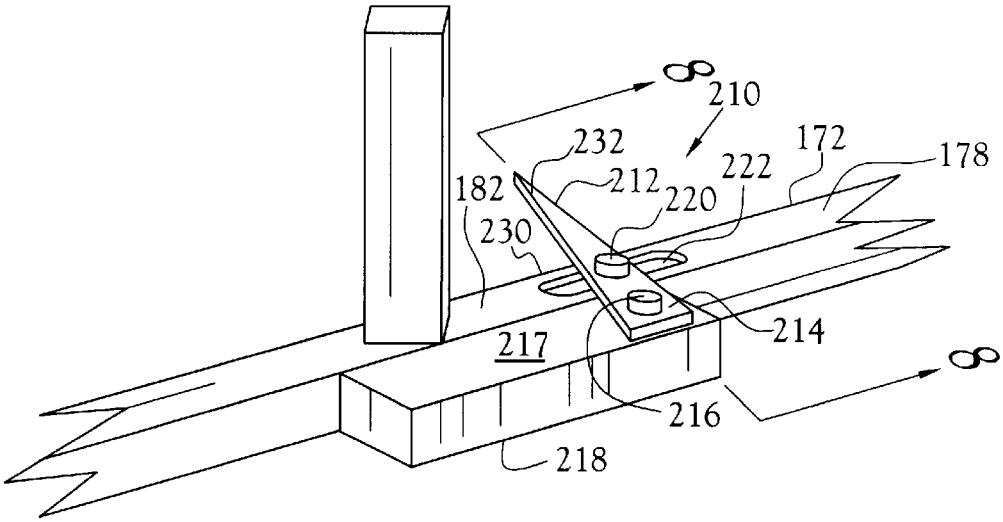
FIG. 7 is a fragmentary representation of one embodiment of an indicator employed with a gauge.
Figure 8:
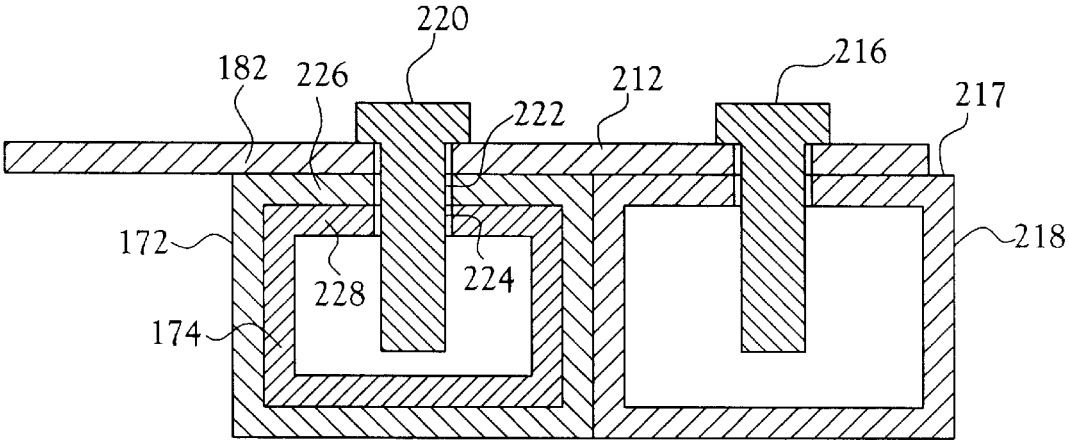
FIG. 8 is a sectional view of the indicator and taken generally along line 8—8 of FIG. 7.

As seen in FIGS. 1, 4 and 5, the outboard end 72 of the first rigid tubular member 68 terminates in the form of a first lug 74 which depends from the outboard end of the tubular member and which, at its distal end, is curved inwardly toward the rail R' and presents a terminal face 76 which is designed to engage the outside surface 78 of the rail to permit the application of a force against the outside surface of the rail which tends to move the rail inwardly toward its companion rail R. The outboard end 80 of the second elongated rigid member 70 similarly terminates in the form of a second lug 82 which depends from the outboard end of the rigid member and which, at its distal end 84, is curved inwardly toward the rail R and presents a terminal face 86 which is designed to engage the outside surface 88 of the rail R to permit the application of a force against the outside surface of the rail which tends to move the rail inwardly toward its companion rail R'. On the underside 90 of the first rigid tubular member 68, adjacent the outboard end thereof 72, there is provided a third lug 92. This third lug depends from the underside of the tubular member and is spaced inwardly of the terminal end of the tubular member by a distance sufficient to provide a separation distance between the first lug 74 and the third lug 92 as permits the interposition of the rail R' between these lugs. Accordingly, the third lug 92 provides an outwardly directed face 94 which is in position to engage the inside top edge 34 of the rail R' and to apply a moving force to the rail R' in a direction away from its companion rail R. In like manner, a fourth lug 96 is provided on the underside 98 of the rigid member 70 and spaced inwardly of the terminal end of the rigid member 70 by a distance sufficient to provide a separation distance between the second and fourth lugs as permits the interposition of the rail R between these lugs. Like the third lug, the fourth lug includes an outwardly directed face 100 which is in position to engage the inside top edge 32 of its respective rail R and to apply a moving force to the rail in a direction away from the companion rail R'.

Telescoping movement of the first elongated hollow tubular member 68 and the elongated rigid member 70 slidably received therein is effected in the preferred embodiment by a double-acting hydraulic piston/cylinder device 102. As depicted in FIGS. 1, 4 and 5, one end 104 of the cylinder element 106 of the piston/cylinder device is anchored to a bracket 108 affixed to the upperside 110 of the first hollow tubular member 68 adjacent the terminal end 72 thereof. From this mounting location, the cylinder extends along and overlies the upper surface 110 of the first hollow tubular member and terminates short of the opposite terminal end 80 of the second rigid member 70. At a location adjacent the terminal end 80 of the second rigid member, there is provided a bracket 112 affixed on the upperside 114 of the second rigid member 70. The outboard end 114 of the piston element 116 of the piston/cylinder device is pinned to the bracket 112 as by a pin 118. The inboard end 120 of the piston element 116 is operatively received within the cylinder element 106. The opposite ends 104 and 122 of the cylinder element 106 are connected in fluid communication with a source of pressurized hydraulic fluid 124 by means of first and second hoses 126 and 128. A control valve 130 is interposed between the first and second hoses 126 and 128 and the source of pressurized hydraulic fluid 124. Upon the admission of pressurized hydraulic fluid to the left hand end 104 of the cylinder member 106 (as viewed in FIG. 1), the piston element 116 is extended from the cylinder element 106 to increase the separation distance of the third and fourth lugs 92,96 and thereby cause these lugs to engage their respective inside edges of their respective rails and urge the rails away from one another and increase the spacing therebetween. Conversely, upon the admission of pressurized hydraulic fluid to the right hand end 122 of the cylinder member (as viewed in FIG. 4), the piston element 116 is retracted into the cylinder element 106 to decrease the separation distance of the first and second lugs 74,82 and thereby cause these lugs to engage their respective outside surfaces of their respective rails and urge the rails toward one another and decrease the spacing therebetween. The range of lateral extension of gripper assembly 62 and telescoping arm 70 includes a range of extension greater than the maximum acceptable separation distance between rails R, R', and a range of retraction greater than the minimum acceptable separation distance between rails R and R'.

In the depicted embodiment, the vehicle is provided with a portable system for the provision of pressurized hydraulic fluid for various purposes. The depicted system includes a reservoir 130 for hydraulic fluid, a pump 132, a portable engine 134 for operation of the pump, and a control valve 130 having a control handle 135, interposed along the length of the first and second hoses 126 and 128, respectively which feed pressurized hydraulic fluid to the piston/cylinder device and third and fourth hoses 136,138 which supply pressurized hydraulic fluid to a further piston/cylinder device 140. The various components of the pressurized hydraulic system are mounted on the frame 12, either directly or indirectly. Specifically, in the preferred embodiment, the control valve 130 is mounted on the rear end 48 of the rear portion 60 of the arm 44 and therefore in position for ready access by an operator of the vehicle who is positioned adjacent the rear end of the vehicle, such as walking or standing to the rear the vehicle.

Referring specifically to FIGS. 1 and 2, rotation of the arm 44 about its pivotal mounting 45 to the support 52 may be effected or assisted, as desired, by means of the further piston/cylinder device 140. This device is anchored at one of its ends 150 to the frame 12 and at its opposite end 152 to the arm 44. This piston/cylinder device may be of a double/acting type and powered by pressurized hydraulic fluid flowing through the third hose 138 connected between the control valve and the outboard end of the cylinder element of the device and a fourth hose 136 connected between the control valve and that end of the cylinder element which is anchored to the frame. By this means the device may be employed to selectively exert a downwardly directed force to the arm to pivot the arm about its pivotal mounting on the support to thereby raise the front end of the arm and the rail gripper assembly off the rails or an upwardly directed force to pivot the arm and lower the rail gripper assembly into engagement with the rails. This feature of the invention is useful for permitting an operator to raise or lower the massive and relatively heavy rail gripper between its positions of engagement and disengagement with the rails R,R'.

In FIG. 3, there is depicted one embodiment of a gauge 160 adapted to extend between rails R R' at any given location along rails, and to provide an indication of the spatial distance between the rails at each location. In use, the gauge 160 is located normal to rails R,R' with each of the opposite ends 162, 164 thereof being adapted for positively engaging each of the respective rails R, R'. The gauge 160 may be moved along in close proximity to the frame 12 from location to location for gauging of the distance between rails R and R' either manually by an operator or it may be mounted on the frame either at a location ahead of, underneath, or adjacent the rear of the frame. As seen in FIG. 3, the depicted gauge includes a first elongated member 166 having a first end 168 thereof telescopically received with a first end 170 of an elongated hollow tubular connector member 172. The depicted gauge further includes a second elongated member 174 having a first end 176 thereof telescopically received in a second end 178 of the connector member 172. A locking member, depicted in the form of a handle 180 having a threaded end which is threadably received within a threaded bore in the upper surface 182 of the first end 170 of the connector member and projecting into the interior of the hollow connector member to frictionally engage the first end 176 of the first elongated member 174 disposed within the connector, is provided for adjustably selecting the extent to which the first end 176 of the first elongated member 174 extends into the connector, hence the overall length of the gauge. Each of the outboard ends 184, 186 of each of the elongated members 166 and 174, respectively, is adapted to engage and move along a respective one of the rails R,R'. To this end, the outboard end 186 of the elongated member 174, for example, is provided with an elongated carriage member 190 that is affixed to the outboard end 186 of the member 174 and extends normally thereof. In the depicted embodiment, the carriage 190 comprises a length of metal bar of L-shaped cross section. One planar leg 192 of the metal bar is disposed horizontally and includes first and second rollers 194 and 196, mounted on respective ones of the opposite ends 198 and 200, thereof with their respective circumferential bearing surfaces facing the inboard edge 32 of the rail. The other planar leg 202 of the metal bar is oriented vertically and includes third and fourth rollers 204 and 206 mounted on respective ends thereof with their respective circumferential bearing surfaces facing the top surface 208 of the rail R. The outboard end 184 of the tubular member 166 of the gauge is provided with a like carriage 190' having like arrangements of rollers 194', 196', 204', 206', so that when the gauge is positioned between adjacent rails, with one end of the gauge engaging one rail and the opposite end engaged the other of a set of spaced apart rails, the rollers at each end of the gauge serve to support the gauge for movement along the length of the rails, and the rollers engage respective ones of the inboard edges of the rails and serve as end-points for measuring the distance between the rails.

In accordance with one embodiment, the gauge includes an indicator 210 at a location along the length of the tubular connector 172. This indicator 210 is designed to provide an indication of the extent to which the rails are out of gauge and the direction which the rails need to be moved, if any, to bring the rails into gauge. In one embodiment, depicted in FIGS. 3,7 and 8 this indicator takes the form of a pointer 212 that has one of its ends 214 pivotally mounted by a pivot pin 216 to the upper surface 217 of a lateral extension 218 of the connector member 172. At a location spaced along the length of the pointer from its pivot pin 216, the pointer is provided with a pin 220. This pin 220 extends through a slot opening 222 provided in the upper wall 182 of the connector to engage a bore 224 in the upper wall 226 of the connector member 172, thence through a bore 226 in the upper wall 228 of the elongated member 174. The slot opening 222 may have edge margin markings 230 indicating the gauge of the rails and the direction in which the rails are out of gauge.

In this embodiment, telescopic movement of the second member 174 relative to hollow connector member 172 causes the pointer 212 to pivot about its pivot pin 216 and its outboard end 232 to swing in an arcuate path away from a central or neutral position that is chosen to be normal to the length dimension of the gauge when the overall length of the gauge is at gauge for the rails. When the pointer is at a central or neutral position, the rails are in gauge. Movement of the indicator pointer in a first direction away from a central or neutral position indicates that rails are too close together, while movement of the pointer in the opposite direction from neutral indicates that the rails are spaced too far apart. It is to be recognized that other gauging devices may be employed, such as a measuring tape or the like. Further, the gauge may be in the form of a set of telescoping members, one of which is anchored to the first elongated hollow tubular member 68 of the rail gripper and the other of which is anchored to the second elongated rigid member 70, with an indicator interposed along the length of the gauge for indicating the degree and direction of any "out of gauge" condition of a set of rails.

An alternate embodiment to providing a visual display is to incorporate an audible indicator of rail separation distance as part of gauge.

The method of operation of the apparatus for gauging and adjusting the distance between rails includes the steps of maneuvering the mobile vehicle onto the rails of a section of railroad track, for example, gauging the separation distance between the rails, providing an indication of the status of the rails with respect to their desired separation distance, positioning a rail gripper in juxtaposition to respective sides of the rails, applying an extension or retraction force to the gripper to alter the effective length of the gripper to bring selected ones of its end lugs into engagement with selected portions of the rails to bring the rails into gauge, securing the rails in their adjusted gauge positions, and disengaging the rail gripper from the rails.

In the preferred method, the spikes normally used to anchor the rails of a railroad, for example, in their desired positions are removed prior to an adjusting operation to allow free movement of the rails by the present apparatus. Once the rails are returned to gauge the spikes may be replaced to secure the rails in gauge. As desired, the vehicle 12 may further be outfitted with a hydraulically powered jack hammer 250 (see FIG. 6) held in a receptacle 252 and available for removing or driving spikes. Hoses 254 and 256 provide for fluid flow connection between the control valve 130 and the jack hammer.

The mobile vehicle 12 depicted in FIGS. 1–8 is lightweight and is easily maneuverable by a single operator to a multitude of sections of rails requiring adjustments. The ease of movement, the ease of gauging distance between the rails, both before and after adjustment of the rails, and the ease of adjusting and of manipulating the rail gripper provides a time-efficient and low-cost method for gauging and adjusting distances between railroad rails.

Figure 9:
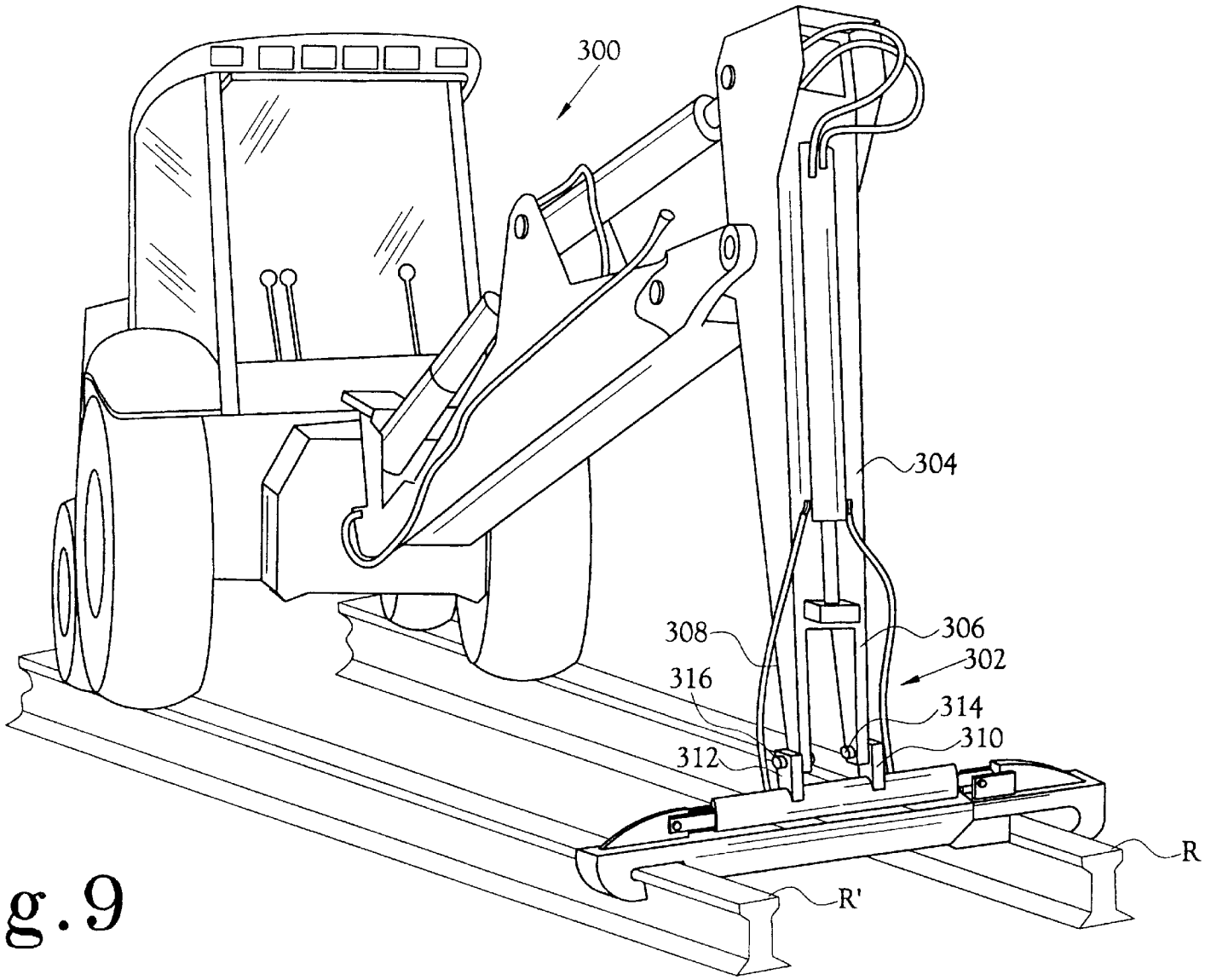
FIG. 9 is a representation of a rail gripper of the present invention mounted on the boom of a backhoe vehicle.

With reference to FIG. 9, a further embodiment of the present invention comprises a backhoe 300 which serves as the vehicle for mounting of the rail gripper. As shown in FIG. 9, the outboard end 302 of the boom 304 of the backhoe includes first and second legs 306 and 308. In this embodiment, the rail gripper is provided with first and second spaced apart mounting lugs 310 and 312 which project upwardly from the rail gripper. For mounting of the rail gripper to the boom, the legs 306 and 308 of the backhoe are positioned adjacent respective ones of the mounting lugs 310 and 312 and pivotally secured to the mounting lugs as by pivot pins 314 and 316 which pass through registered throughbores (not shown) in the mounting lugs and in the legs of the boom. If desired this type of pivotal mounting of the rail gripper may be applied in mounting of the rail gripper 62 of FIG. 1 to the outboard end of the arm 44. Such pivotal mounting of the rail gripper provides enhancement of the ease of fit of the ends of the rail gripper to the rails.

Whereas one skilled in the art will undoubtedly recognize variations and associated embodiments such as different power sources, alterations in orientation of equipment to other equipment on, or in close proximity to the vehicle. As the foregoing description is exemplary in nature, the invention is intended to be limited only by the claims appended hereto.

What is claimed:

1. A system for adjusting the separation distance between adjacent spaced apart elongated rails which are adapted for vehicular traffic thereon, each rail including a top surface, an outboard surface and an inboard surface, wherein the inboard surfaces of the rails face one another comprising a vehicle adapted to be mounted on and to move along the length of the rails, a rail gripper mounted on said vehicle for movement of said rail gripper between positions of engagement and disengagement with the rails, said rail gripper including means extending between and bridging the distance between the rails including at least first and second elongated members that are moveable relative to one another to selectively adjust the effective length of said rail gripper between retracted and extended positions and having first and second opposite ends, each of said first and second ends including a portion thereof adapted to engage the top surface of a respective rail, an outboard end portion which depends from said first end of said platform means by a distance sufficient to permit said outboard end portion to engage the outboard surface of a respective rail, an inboard end portion which depends from said first end of said platform means by a distance sufficient to permit said inboard end portion to engage the inboard surface of a respective rail, said outboard end portion and said inboard end portion being spatially separated by a distance sufficient for the interposition of a respective rail therebetween when said rail gripper is disposed in its positions of engagement with the rails, and means for selectively adjusting the length of said rail gripper between its retracted and extended positions with a force which is sufficient to move the rails toward or away from one another when the rails are engaged by said first and second ends of said rail gripper.

2. The system of claim 1 wherein said means for selectively adjusting the length of said rail gripper includes at least one double-acting hydraulically-powered piston/cylinder.

3. The system of claim 1 wherein said vehicle includes a boom member having an outboard end, said rail gripper being mounted on said outboard end of said boom member in position to be moved between positions of engagement and disengagement with the rails.

4. The system of claim 3 wherein said vehicle comprises a backhoe.

5. The system of claim 3 wherein said vehicle comprises a dolly adapted to be manually moved along the rails.

6. The system of claim 1 wherein each of said first and second ends of said rail gripper includes a portion thereof adapted to engage the top surface of a respective rail, an outboard end portion which depends from said first end of said rail gripper by a distance sufficient to permit said outboard end portion to engage the outboard surface of a respective rail, an inboard end portion which depends from said first end of said rail gripper by a distance sufficient to permit said inboard end portion to engage the inboard surface of a respective rail, said outboard end portion and said inboard end portion being spatially separated by a distance sufficient for the interposition of a respective rail therebetween.

7. The system of claim 1 and including means for pivotally mounting said rail gripper on said vehicle for pivotal movement of said rail gripper about a pivot axis that extends substantially normal to the length dimension of the rails.

8. The system of claim 7 and including at least two spaced apart mounting lugs associated with said rail gripper, at least two further mounting lugs associated with said vehicle means, each of said mounting lugs defining a throughbore therein and a pivot pin received within said throughbores of said mounting lugs when said throughbores are in register.

9. The system of claim 1 and including an indicator responsive to the separation distance of said first and second opposite ends of said rail gripper.

10. The system of claim 1 wherein said indicator further provides an indication of the direction in which the rails are out of gauge.

11. The system of claim 1 and including hydraulically acutuatable assist means for moving said rail gripper between its positions of engagement and disengagement with the rails.

12. A system for adjusting the separation distance between adjacent spaced apart elongated rails which are adapted for vehicular traffic thereon and including a top surface, an outboard surface and an inboard surface, wherein the inboard surfaces of the rails face one another comprising a vehicle adapted to be mounted on and to move along the length of the rails and including an articulated boom member, a rail gripper, means mounting said rail gripper on said vehicle for movement of said rail gripper between positions of engagement and disengagement with the rails, and including means for pivotal movement of said rail gripper about a pivot axis that extends normal to the length dimension of the rails, said rail gripper extending between and bridging the distance between the rails including at least first and second elongated members that are telescopically moveable relative to one another to selectively adjust the effective length of said rail gripper between retracted and extended positions and having first and second opposite ends, each of said first and second ends including a portion thereof adapted to engage the top surface of a respective rail, an outboard end portion which depends from said first end of said platform by a distance sufficient to permit said outboard end portion to engage the outboard surface of a respective rail, an inboard end portion which depends from said first end of said platform by a distance sufficient to permit said inboard end portion to engage the inboard surface of a respective rail, said outboard end portion and said inboard end portion being spatially separated by a distance sufficient for the interposition of a respective rail therebetween when said rail gripper is disposed in its positions of engagement with the rails, at least one hydraulic piston/cylinder interconnecting said first and second elongated members for selectively adjusting the length of said rail gripper between its retracted and extended positions with a force which is sufficient to move the rails toward or away from one another when the rails are engaged by said first and second ends of said rail gripper.

13. The system of claim 12 wherein said telescoping members of said rail gripper include a range of extension greater than the maximum acceptable separation distance between the rails, and having a range of retraction greater than the minimum aceptable separation distance between the rails, whereby said end portions on said first end and on said opposite second end of said rail gripper are selectively positionable against the respective inboard surfaces of the rails for spreading the rails apart, or against the respective outboard surfaces of the rails for drawing the rails toward one another.

14. The system of claim 13 wherein each of said end portions of said rail gripper comprises an outer lug member depending from said end portion and having an inwardly facing surface for engaging the outboard surface of a respective one of the rails, and an inner lug member depending from said lower surface of said rail gripper and having an outwardly facing surface for engaging said inboard surface of a respective one of the rails, whereby said outer lug members and said inner lug members are positionable to engage the rails when said rail gripper is lowered onto the rails.

15. A method for adjusting the separation distance between adjacent spaced apart elongated rails which are adapted for vehicular traffic thereon comprising the steps of:

(a) maneuvering a mobile vehicle onto said rails, said vehicle including a frame adapted to ride along said rails, said frame having front and rear ends traversing the distance between said rails and first and second sets of wheel assemblies mounting said frame between said rails for movement of said vehicle along said rails;

(b) gauging the distance between said rails at a given location and generating an observable indication of the spatial distance between said rails at said given location;

(c) moving a telescoping rail gripper into juxtaposition to said rails;

(d) employing a hydraulically powered assembly, selectively altering the degree of telescoping of said rail gripper to thereby lengthen or shorten said rail gripper to apply a laterally directed moving force to said rails;

(e) continuing the application of said lateral force to said rails until said rails are in gauge.

16. The method of claim 15 and including the steps of disengaging said rail gripper from said rails, repositioning said mobile vehicle at another location along said rails, and repeating steps (b) through (e) of claim 15.

17. The method of claim 15 and including the step of pivotally mounting said rail gripper in cantilevered fashion adjacent said front end of said vehicle for movement between positions of engagement and disengagement with said rails.

* * * * *